United States Patent [19]

Yamamoto et al.

[11] Patent Number: 5,036,805

[45] Date of Patent: Aug. 6, 1991

[54] OUTBOARD ENGINE

[75] Inventors: Hiroshi Yamamoto; Hitoshi Suzuki; Yasushi Itai, all of Saitama, Japan

[73] Assignee: Honda Giken Kogyo Kabushiki Kaisha, Tokyo, Japan

[21] Appl. No.: 509,747

[22] Filed: Apr. 17, 1990

[30] Foreign Application Priority Data

Apr. 17, 1989 [JP] Japan ..... 1-96767
Nov. 29, 1989 [JP] Japan ..... 1-309465

[51] Int. Cl.[5] ..... F02B 75/20
[52] U.S. Cl. ..... 123/59 PC; 123/579
[58] Field of Search ..... 123/59 PC, 579, 580, 123/581, 582, 583, 584, 195 P

[56] References Cited

U.S. PATENT DOCUMENTS 3,030,819 4/1962 Edelbrock, Jr. ..... 123/59 PC
4,532,904 8/1985 Osawa et al. ..... 123/580
4,846,124 7/1989 Suzuki et al. ..... 123/195 P

FOREIGN PATENT DOCUMENTS 62-78438 4/1987 Japan ..... 123/579
62-124229 8/1987 Japan .
62-184163 11/1987 Japan .

*Primary Examiner*—Noah P. Kamen
*Attorney, Agent, or Firm*—Dickstein, Shapiro & Morin

[57] ABSTRACT

An in-line multicylinder outboard engine for an outboard engine unit including a vertical array of cylinders, a vertically extending crankshaft, a flywheel mounted on the upper end of the crankshaft, and a camshaft driver unit positioned between the flywheel and an upper surface of an engine block. The engine also includes a vertical array of intake/fuel supply devices connected respectively to pipes of an intake manifold. The uppermost intake/fuel supply device has at least a portion of it positioned below a plane in which the flywheel is rotatable and within a region defined laterally of the camshaft driver unit. The pipes of the intake manifold have equal lengths.

17 Claims, 7 Drawing Sheets

OUTBOARD ENGINE

BACKGROUND OF THE INVENTION

1. Field of the Invention:

The present invention relates to an engine, and more particularly to an in-line, multicylinder outboard engine equipped with intake/fuel supply devices.

2. Description of the Relevant Art:

Outboard engines which are detachably mounted on the stern of ships or boats outside of the hull should preferably be small in size and yet capable of producing high output power. Generally, many outboard engines as installed on vessels have cylinders oriented such that their axes lie horizontally and crankshafts are directed vertically. One problem of conventional outboard engines is that intake/fuel supply devices associated therewith are so located as to prevent the engines from operating with sufficient performance capability and also to increase the external dimensions of the engines.

One known multicylinder outboard engine is disclosed in Japanese Laid-Open Utility Model Publication No. 62-124229 published on Aug. 7, 1987. The disclosed engine has a pair of upper and lower cylinders and an intake/fuel supply device disposed on one side of the upper cylinder. The intake/fuel device includes a carburetor coupled to the cylinders through a pair of intake manifolds, for supplying and distributing an air-fuel mixture to the cylinders.

Japanese Laid-Open Utility Model Publication No. 62-184163 published on Nov. 21, 1987 also discloses an outboard engine of a V-shaped multicylinder configuration. The engine includes a pair of V-shaped banks of vertically arranged cylinders. As many carburetors as the number of cylinder pairs are disposed in the cylinder banks for supplying and distributing an air-fuel mixture to the cylinders through an intake manifold.

With the two-cylinder outboard engine disclosed in the former publication, no serious problem arises from the fact that an air-fuel mixture is distributed from the single carburetor to the upper and lower cylinders. However, if an air-fuel mixture is supplied from a single carburetor to more engine cylinders, then the air-fuel mixture may not be distributed uniformly to the engine cylinders since the pipes connecting the intake manifold to the respective cylinders have different lengths. More specifically, if the intake manifold pipes connecting the carburetor to the engine cylinders have different lengths, then the air-fuel ratio of the air-fuel mixture in the intake manifold pipes varies due to air-fuel mixture flows along the manifold walls, resulting in difficulty supplying the air-fuel mixture at an appropriate air-fuel ratio to the cylinders. As a consequence, no stable engine response is achieved especially while the engine is idling. The carburetor is usually positioned higher than the intake ports of the engine cylinders in order to prevent the fuel from being trapped in the intake manifold. One solution is to employ a vertical array of carburetors along the array of the cylinders. However, the size of such multiple carburetors that can be employed is limited because of the dimensional relationship between the vertical pitch of the carburetors and the vertical pitch of the cylinder bores. It is only possible either to employ carburetors having small bore diameters, which are however not preferable from the standpoint of producing higher engine output power, or to employ intake manifold pipes having different lengths. The engines with those carburetors or intake manifolds cannot produce higher engine output power or operate with low responses.

If an array of multiple carburetors is to be used with a bank of engine cylinders, then it is preferable for the carburetors to be coupled to a throttle adjusting link mechanism which should be as simple as possible.

The outboard engine disclosed in the latter publication is free from the aforesaid drawbacks since as many carburetors as the number of cylinder pairs are vertically arrayed. The vertical array of carburetors is suitable for use with engines such as V-shaped cylinder engines which have a space defined between the cylinder banks and which provide a large distance between upper and lower cylinders. However, the vertical array of carburetors cannot easily be combined with engines such as in-line engines whose cylinders are spaced shorter distances from each other. If as many carburetors as the number of engine cylinders are disposed on one side of a vertical in-line engine, the vertical position of the uppermost carburetor is limited by the fly-wheel positioned upwardly of the upper end of the engine block, and the vertical position of the lowermost carburetor is also limited by the lower case of the engine.

The present invention has been made in an effort to effectively solve the above-noted problems of the conventional outboard engines and/or meet the performance demands for outboard engines.

SUMMARY OF THE INVENTION

It is an object of the present invention to provide a vertical in-line, multicylinder outboard engine which is associated with appropriately located intake/fuel supply devices for sufficient engine performance capability, and which is small in size.

Another object of the present invention is to provide a vertical in-line, multicylinder outboard engine having a simple throttle adjusting link mechanism connected to carburetors.

Still another object of the present invention is to provide a vertical in-line, multicylinder outboard engine which is equipped with intake/fuel supply devices capable of supplying an air-fuel mixture at a proper air-fuel ratio to engine cylinders especially while the engine is idling, so that the engine can operate with a stable engine response.

To achieve the above objects, there is provided an in-line multicylinder outboard engine for an outboard engine unit, comprising an engine block having a vertical array of cylinders therein, a crankshaft disposed substantially vertically in the engine block and having an upper end projecting from an upper surface of the engine block, a flywheel mounted on the upper end of the crankshaft, a cylinder head connected to the cylinders, a camshaft driver unit positioned between a plane in which the flywheel is rotatable and the upper surface of the engine block, an intake manifold extending from the cylinder head onto one side of the engine block and having pipes, and a vertical array of intake/fuel supply devices connected respectively to the pipes of the intake manifold, and the intake/fuel supply devices including an uppermost intake/fuel supply device which has at least a portion thereof positioned below the plane in which the flywheel is rotatable and within a region defined laterally of the camshaft driver unit.

The in-line multicylinder outboard engine also includes links connected to the carburetors and disposed on one side thereof.

The pipes of the intake manifold extending from the cylinder head have equal lengths.

The above and further objects, details and advantages of the present invention will become apparent from the following detailed description of preferred embodiments thereof, when read in conjunction with the accompanying drawings.

DETAILED DESCRIPTION OF THE PREFERRED EMBODIMENTS

Figure 1:
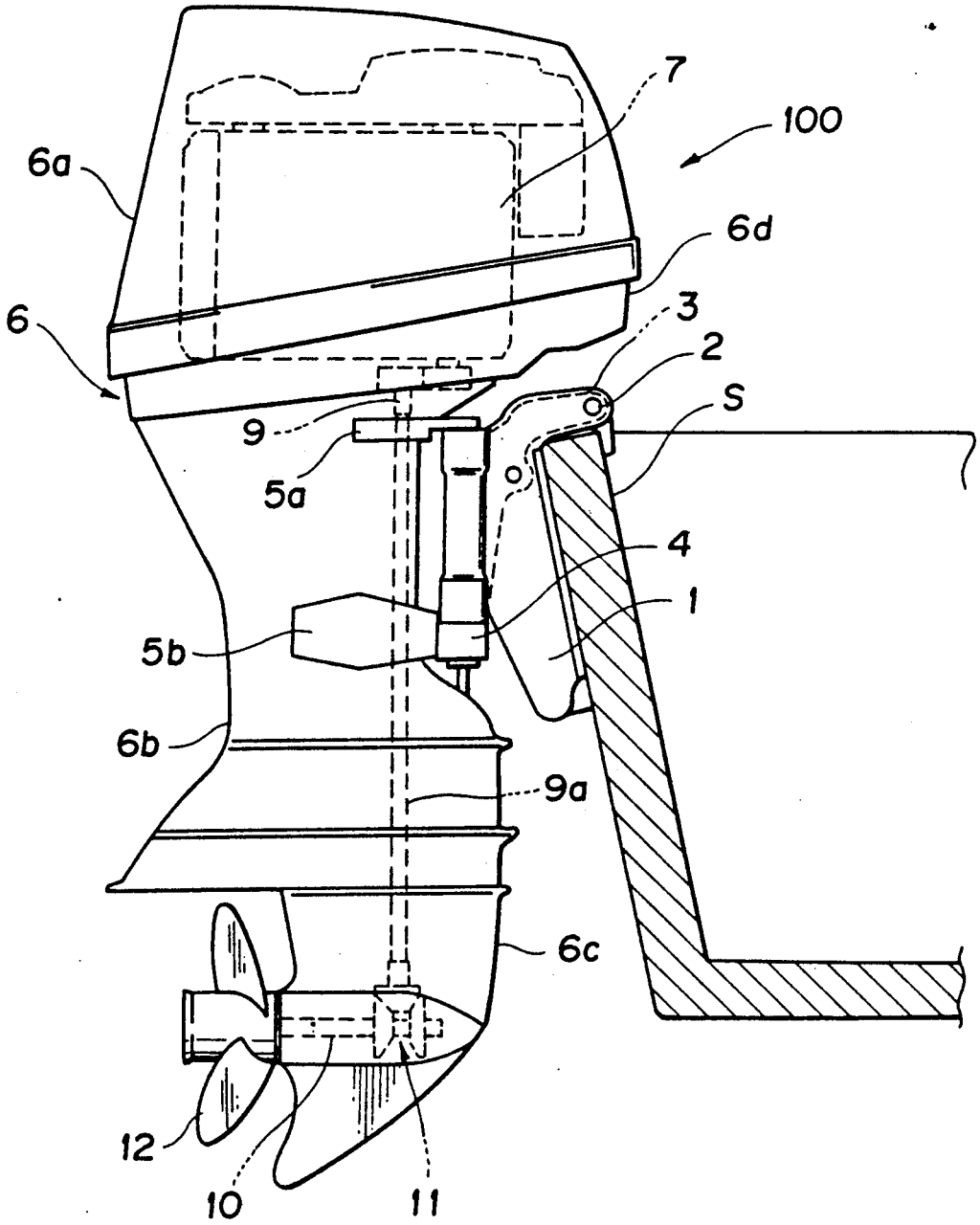
FIG. 1 is a side elevational view of an outboard engine according to a first embodiment of the present invention.

FIG. 1 shows an outboard engine unit 100 including an outboard engine 7 according to a first embodiment of the present invention. The outboard engine unit 100 has a stern bracket 1 which is detachably attached to the stern S of a boat. The bracket 1 has a pivot shaft 2 on which a swivel case 3 is mounted for swinging movement about the pivot shaft 2. A vertical swivel shaft 4 which is rotatable about its own axis is disposed in the case 3. Support arms 5*a*, 5*b* are secured to and extend rearwardly from the upper and lower ends of the swivel shaft 4. The outboard engine unit 100 has an outer casing means or assembly 6 coupled to the support arms 5*a*, 5*b*. The casing assembly 6 comprises an engine cover 6*a*, a lower case 6*d*, an extension case 6*b*, and a gear case 6*c*, which are arranged successively from above in the order named.

The outboard engine 7 is housed in an upper portion of the casing assembly 6. The engine 7 has an output shaft 9 on its lower side, the output shaft 9 being splined at its lower end to a downwardly extending vertical shaft 9*a*. The lower end of the vertical shaft 9*a* is coupled to a joint 11 of a propeller shaft 10. The propeller shaft 10 has a rear portion projecting rearwardly from the gear case 6*c*, with a propeller 12 being mounted on the projecting rear end of the propeller shaft 10.

Figure 3:
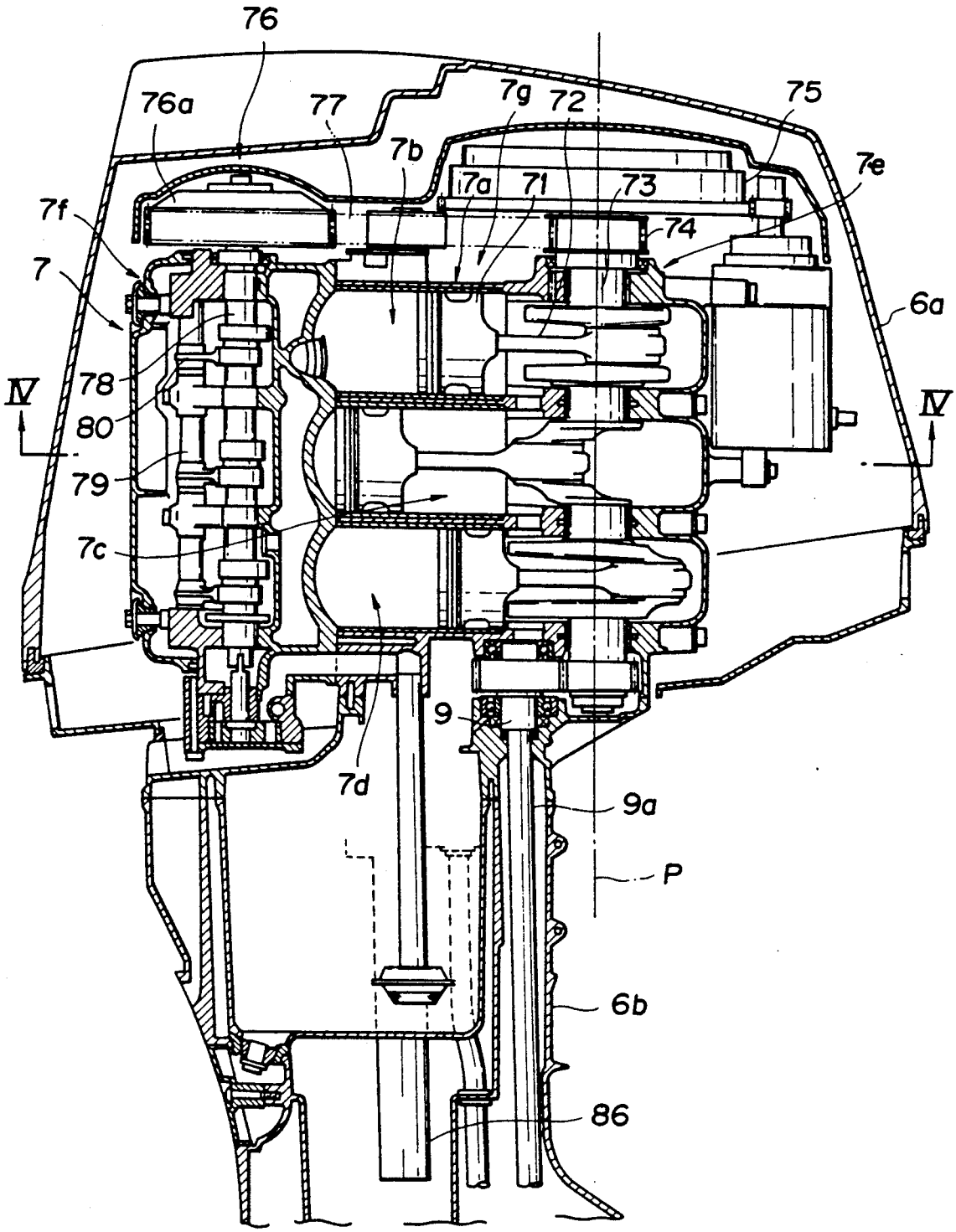
FIG. 3 is an enlarged vertical cross-sectional view of the outboard engine shown in FIG. 1.

As shown in FIG. 3, the outboard engine 7 comprises a four-cycle in-line, three-cylinder engine of the single-overhead-camshaft (SOHC) type. More specifically, the outboard engine 7 comprises an in-line three-cylinder engine of the Siamese type with the cylinder axes arrayed in a vertical array. The engine 7 has a cylinder assembly 7*a* composed of a vertical array or bank of three cylinders 7*b*, 7*c*, 7*d*. The engine 7 also has a front crankcase 7*e* and a rear cylinder head 7*f* which are integral with the cylinder assembly 7*a*. Pistons 71 are slidably fitted respectively in the cylinders 7*b*, 7*c*, 7*d* and coupled to a crankshaft 73 through respective connecting rods 72. The crankshaft 73 is vertically disposed in the crankcase 7*e* such that the axis P of the crankshaft 73 extends vertically. The crankshaft 73 has an upper end projecting upwardly from an engine block 7*g*. A timing pulley 74 and a flywheel 75 are mounted on the projecting upper end of the crankshaft 73 and positioned above the upper end of the engine block 7*g*.

Figure 4:
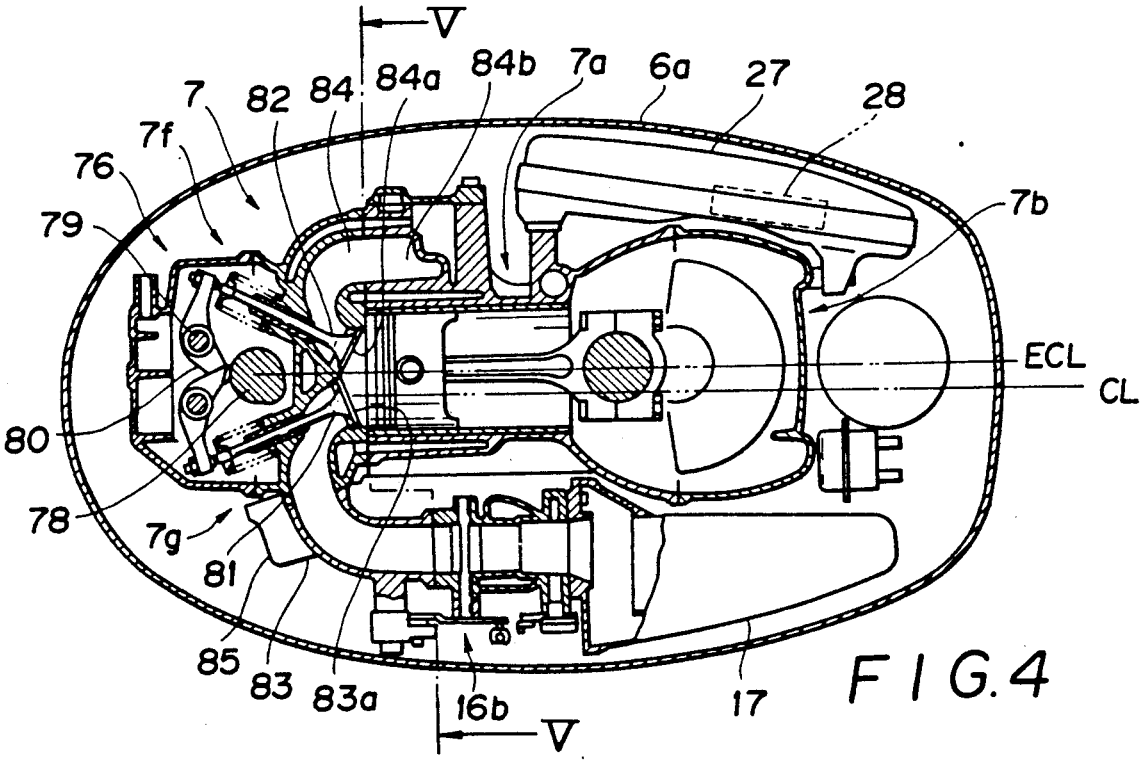
FIG. 4 is a cross-sectional view taken along line IV—IV of FIG. 3.

The engine 7 has a camshaft driver unit 76 positioned between the plane in which the flywheel 75 is rotatable and the upper surface of the engine block 7*g*. The camshaft driver unit 76 includes a cam pulley 76*a* disposed above the cylinder head 7*f* and operatively coupled to the timing pulley 74 by an endless belt 77 which transmits rotation of the crankshaft 73 to a camshaft 78 connected to the camshaft driver unit 76. The pulleys 76*a*, 74 and the endless belt 77 jointly constitute a belt transmission mechanism. When the camshaft 78 is rotated about its own axis, intake valves 81 and exhaust valves 82 shown in FIG. 4 are operated to open and close intake ports 83*a* and exhaust ports 84*a*, respectively, which are connected to the ends of the pipes or ducts of intake and exhaust manifolds 83, 84.

The intake valves 81 and the exhaust valves 82 are arranged in a cross-flow configuration. The intake and exhaust manifolds 83, 84 whose pipes or ducts are openable and closable by the intake and exhaust valves 81, 82 are led to opposite sides of the engine 7. The pipes or ducts of the intake manifold 83 are connected respectively to carburetors 16*a* through 16*c* (FIG. 2) which are disposed on one side of the cylinder assembly 7*a*.

Figure 5:
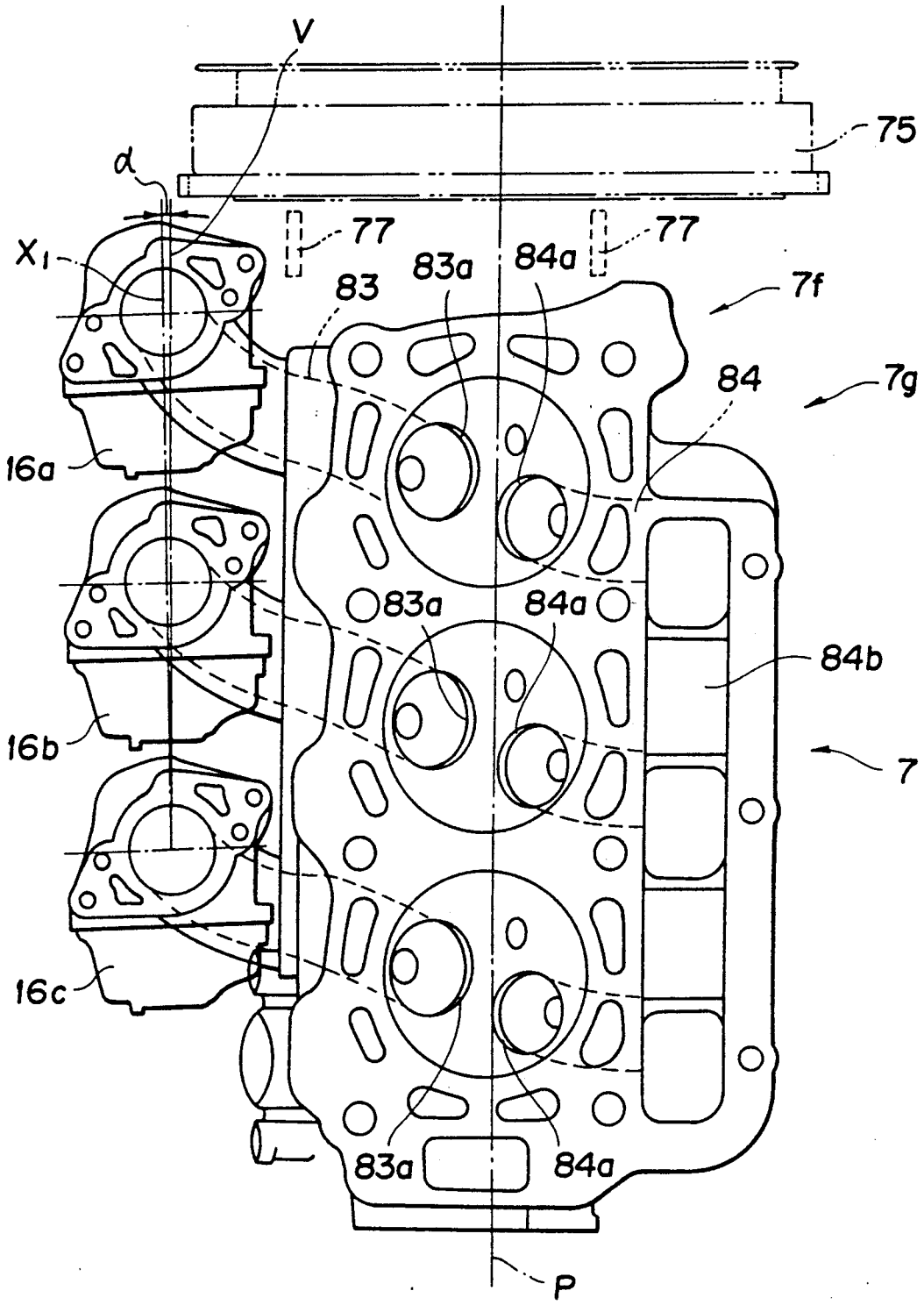
FIG. 5 is a cross-sectional view taken along line V—V of FIG. 4.
Figure 6:
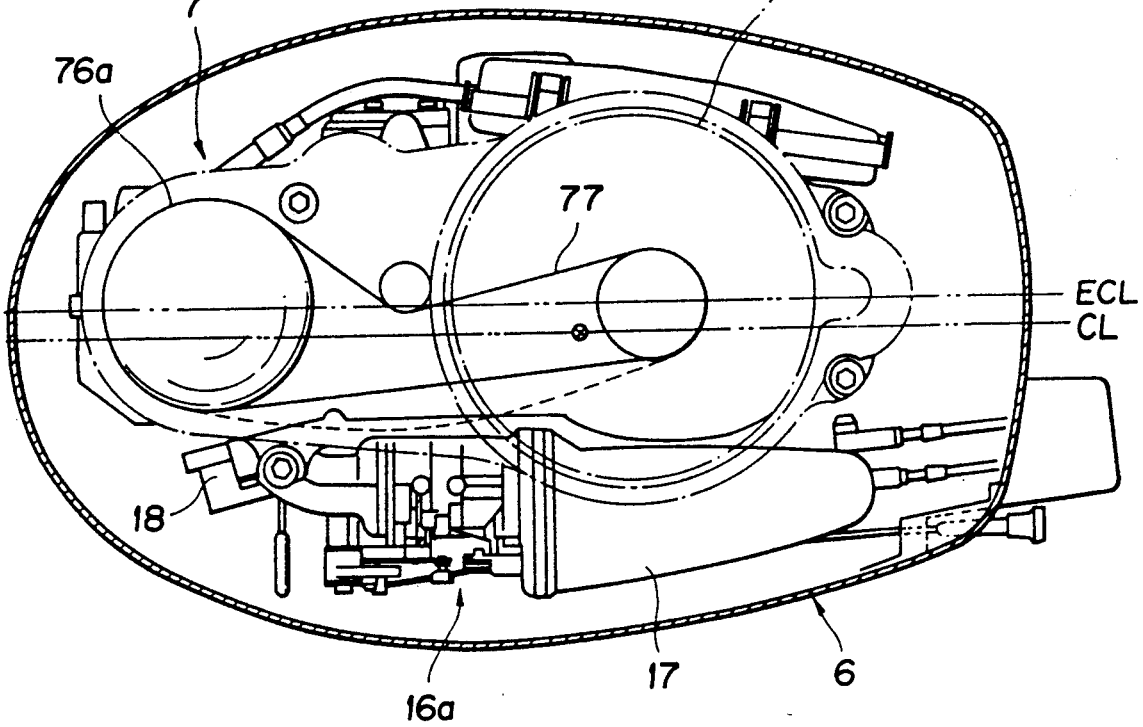
FIG. 6 is a plan view of the outboard engine shown in FIG. 1.

As shown in FIG. 5, the carburetors 16*a* through 16*c* are arranged in a vertical linear array so that they correspond positionally to the engine cylinders 7*b*, 7*c*, 7*d*. The pipes of the intake manifold 83 extend obliquely downwardly from the respective carburetors 16*a* through 16*c* and are connected to the cylinder head 7*f*. The intake manifold pipes 83 are inclined at progressively smaller angles in a downward direction, i.e., the uppermost intake manifold pipe 83 is inclined at a larger angle, the middle intake manifold 83 at an intermediate angle, and the lowermost intake manifold 83 at a smaller angle. Therefore, the carburetors 16*a* through 16*c* are positioned higher than the corresponding intake ports 83*a* of the respective engine cylinders. The vertical pitch of the carburetors 16*a* through 16*c* is greater than the vertical pitch of the cylinders 7*b*, 7*c*, 7*d*, i.e., the carburetors 16*a* through 16*c* are vertically spaced at larger intervals than the cylinders 7*b*, 7*c*, 7*d* are vertically spaced. The carburetors 16*a* through 16*c* have laterally projecting ends which lie in a vertically flat plane. The uppermost carburetor 16*a* has an upper end positioned underneath the plane in which the flywheel 75 rotates. The carburetor 16*a* is positioned above the upper end of the cylinder block 7*a* and in a region defined laterally of the camshaft driver unit 76. To avoid physical interference with the endless belt 77, the carburetors 16*a* through 16*c* are displaced progressively away from the axis P of the crankshaft 73 in the upwardly direction, as shown in FIG. 5. More specifically, the straight line Xl (FIG. 5) passing through the centers of the carburetors 16*a* through 16*c* is angularly displaced a small angle $\alpha$ from the vertical line V parallel to the crankshaft axis P, the angle $\alpha$ being 1.5°. The position of the belt 77 shown in FIG. 5 corresponds to a maximum outward deflection thereof, indicated by the broken line in FIG. 6, when the belt 77 is driven by the pulley 74. The carburetors 16a through 16c thus arranged serve as portions of three intake/fuel supply devices 16.

Figure 2:
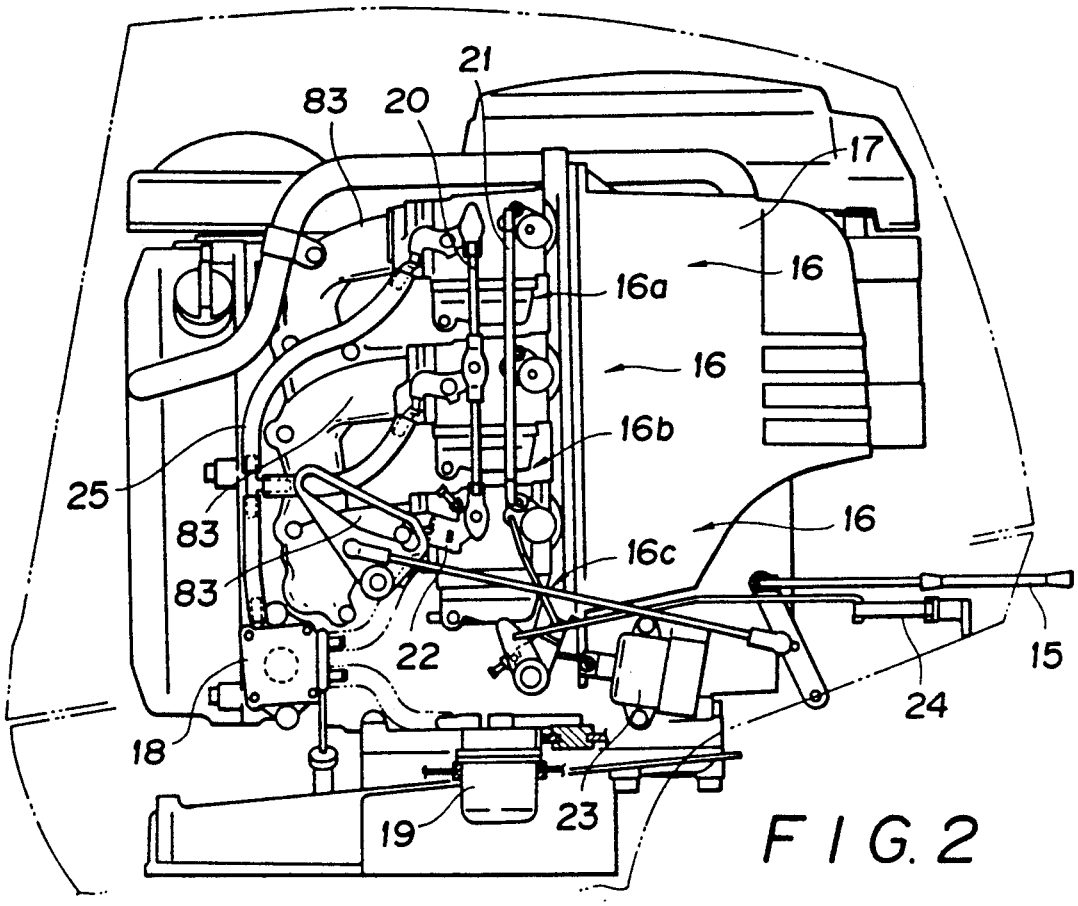
FIG. 2 is an enlarged side elevational view of the outboard engine shown in FIG. 1.

As shown in FIG. 2, the three intake/fuel supply devices 16 include a common intake silencer 17 coupled to intake ports of the carburetors 16a through 16c, and a common fuel pump 18, a common fuel strainer 19, and fuel hoses 25 for supplying fuel to the carburetors 16a through 16c. These components of the three intake/fuel supply devices 16 are disposed alongside of the engine 7 and arranged vertically. Fuel is supplied from a fuel tank (not shown) separate from the outboard engine unit 100 to the fuel strainer 19, and then delivered by the fuel pump 18 through the fuel hoses 25 to the carburetors 16a through 16c. The vertically arrayed carburetors 16a through 16c, which are held in communication with the common intake silencer 17, atomize fuel supplied from the fuel hoses 25 with air introduced from the intake silencer 17, and supply an air-fuel mixture to the intake manifold pipes 83 which are coupled to the cylinder head 7f of the engine 7.

A throttle rod 20 and a choke rod 21 are vertically disposed on the same sides of the carburetors 16a through 16c. The throttle rod 20 is coupled to swingable throttle arms 22 for opening and closing throttle valves (not shown) in the respective carburetors 16a through 16c. The throttle arms 22 can be angularly moved by a throttle remote control system or a link mechanism operated by a manually operable steering handle 15. The choke rod 21 is coupled through a link mechanism to a solenoid 23 and an auxiliary choke knob 24. The choke rod 21 can be operated by the solenoid 23 which is controlled by a choke remote control unit or the auxiliary choke knob 24 which is manually operable.

As shown in FIG. 4, an exhaust manifold 84 is disposed on the other side of the engine 7 remote from the intake/fuel supply devices 16. The exhaust manifold 84 has three pipes or ducts corresponding to the engine cylinders 7b through 7d and extending from the cylinder head 7f. As illustrated in FIG. 5, the pipes of the exhaust manifold 84 have outer ends connected to a common vertical duct 84b whose lower end is connected to an exhaust pipe 86 (FIG. 3). Exhaust gases emitted from the cylinders 7b through 7d flow through the exhaust manifold 84 and are discharged downwardly from the engine 7 through the exhaust pipe 86.

An electric parts box 27, which is also disposed on the exhaust manifold side of the engine 7, houses a capacitor-discharge-type ignition unit 28 for applying a high voltage to spark plugs (not shown) in the respective cylinders 7b through 7d.

As shown in FIG. 3, the axis P of the crankshaft 73 and the axis of the vertical shaft 9a are offset or spaced from each other. As shown in FIG. 4, the outboard engine unit 100 has a central line CL which is offset or spaced laterally from the axis ECL of the cylinders of the engine 7. As a result, the internal space of the casing means or assembly 6 is effectively utilized laterally as well as vertically, creating a wide space for the installation of the intake/fuel supply devices 16.

In the outboard engine unit 100, at least a portion of the uppermost carburetor 16a is disposed below the plane in which the flywheel 75 rotates and within the region which is defined laterally of the camshaft driver unit 76. Consequently, the intake/fuel supply devices 16 which include the vertically arrayed carburetors 16a through 16c can be snugly and neatly accommodated in the limited space in the casing assembly 6. The bore diameter of the carburetors 16a through 16c can be increased for higher engine output power. Since the carburetors 16b, 16c which are lower than the uppermost carburetor 16a are disposed closer to the engine block 7g, the outboard engine unit 100 is rendered relatively small in size.

The cylinders 7b through 7d are supplied with an air-fuel mixture independently from the respective carburetors 16a through 16c of the vertically arrayed intake/fuel supply devices 16. Therefore, even while the engine 7 is idling, the air-fuel mixture is supplied to the cylinders 7b through 7d at a proper air-fuel ratio. The engine response is thus stable even during idling of the engine 7.

Since the carburetors 16a through 16c are linearly arrayed and project laterally to a flat plane, the throttle adjusting link mechanism coupled to the carburetors 16a through 16c is relatively simple in structure.

Figure 7:
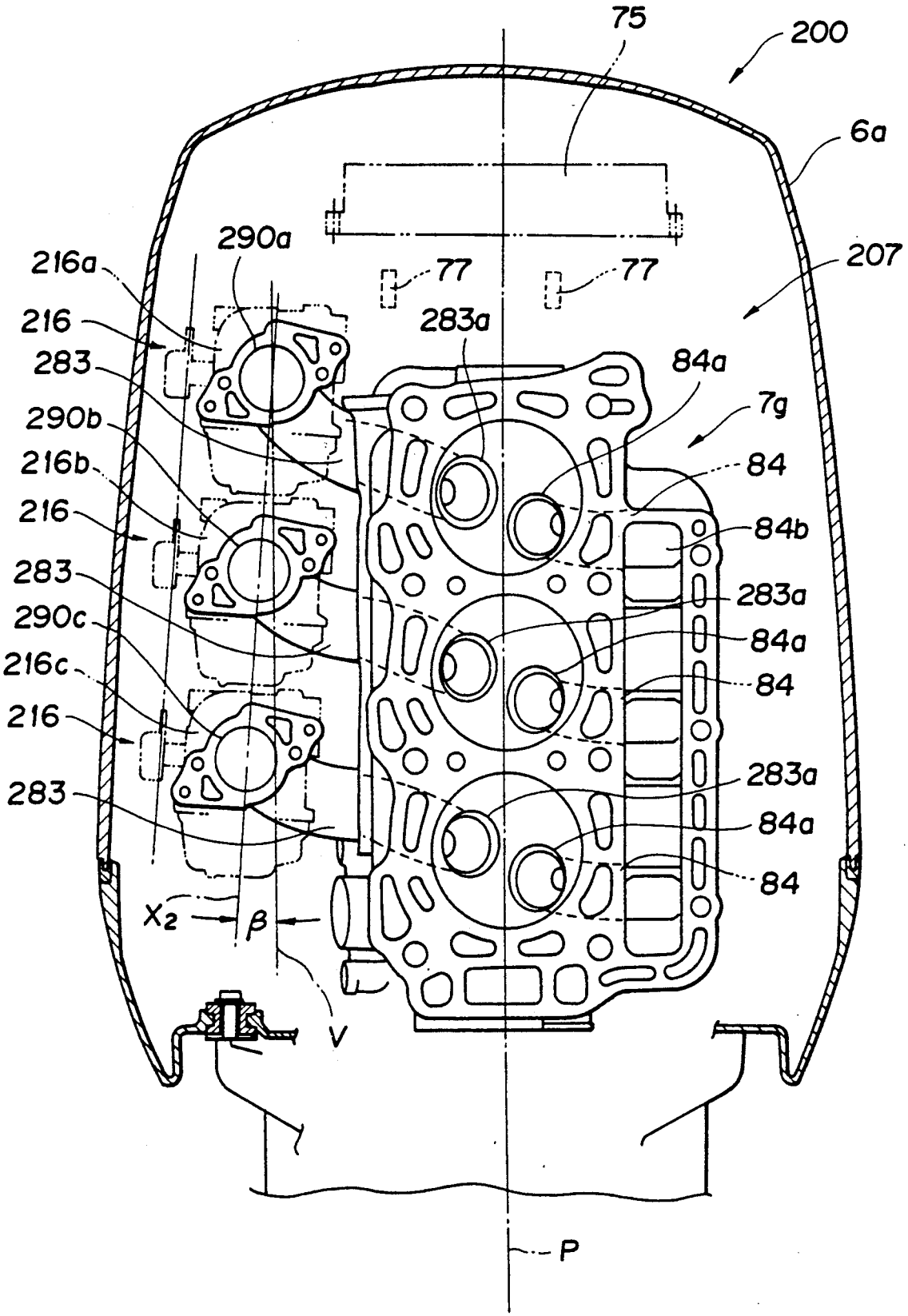
FIG. 7 is a vertical cross-sectional view of an outboard engine according to a second embodiment of the present invention.

FIG. 7 shows an outboard engine unit 200 according to a second embodiment of the present invention. Those parts shown in FIG. 7 which are identical to those shown in FIGS. 1 through 6 are denoted by identical reference numerals, and will not be described below. The outboard engine unit 200 is different from the outboard engine unit 100 as follows:

Three intake/fuel supply devices 216 are disposed in a vertical array on one side of an outboard engine 207. The intake/fuel supply devices 216 include respective carburetors 216a through 216c connected respectively to cylinder intake ports 283a through an intake manifold 283. The intake manifold 283 has pipes coupled to the carburetors 216a through 216c at respective joint surfaces 290a through 290c thereof, and also to the engine cylinders through the intake ports 283a. The vertical pitch of the carburetors 216a through 216c is larger than the vertical pitch of the cylinder bores in the engine cylinders. The three intake manifold pipes 283 are equal in length to each other. Therefore, the distances between the joint surfaces 290a through 290c and the intake ports 283a are the same as each other. As shown in FIG. 7, the carburetors 216a through 216c are spaced progressively more apart outwardly from the vertical axis P of the crankshaft in a downward direction. The line X2 passing through the centers of the joint surfaces 290a through 290c is inclined laterally at an angle $\beta$ with respect to the vertical line V parallel to the axis P. The uppermost carburetor 216a has an upper end which is positioned upwardly of the upper end of the engine block 7g and downwardly of the plane in which the flywheel 75 rotates.

The engine 207 of the outboard engine unit 200 offers the same advantages as those of the engine 7 of the outboard engine unit 100.

In the engine 207, the lengths of the pipes of the intake manifold 283 are of the same length. Therefore, the intake manifold 283 can supply an air-fuel mixture at a proper air-fuel ratio to the engine cylinders. This is particularly advantageous when the vacuum in the intake manifold 283 is reduced and the supplied air-fuel mixture tends to be liquified by air-fuel mixture flows along the intake manifold walls, while the engine 207 is idling. Consequently, the engine response is stable during idling of the engine 207.

Figure 8:
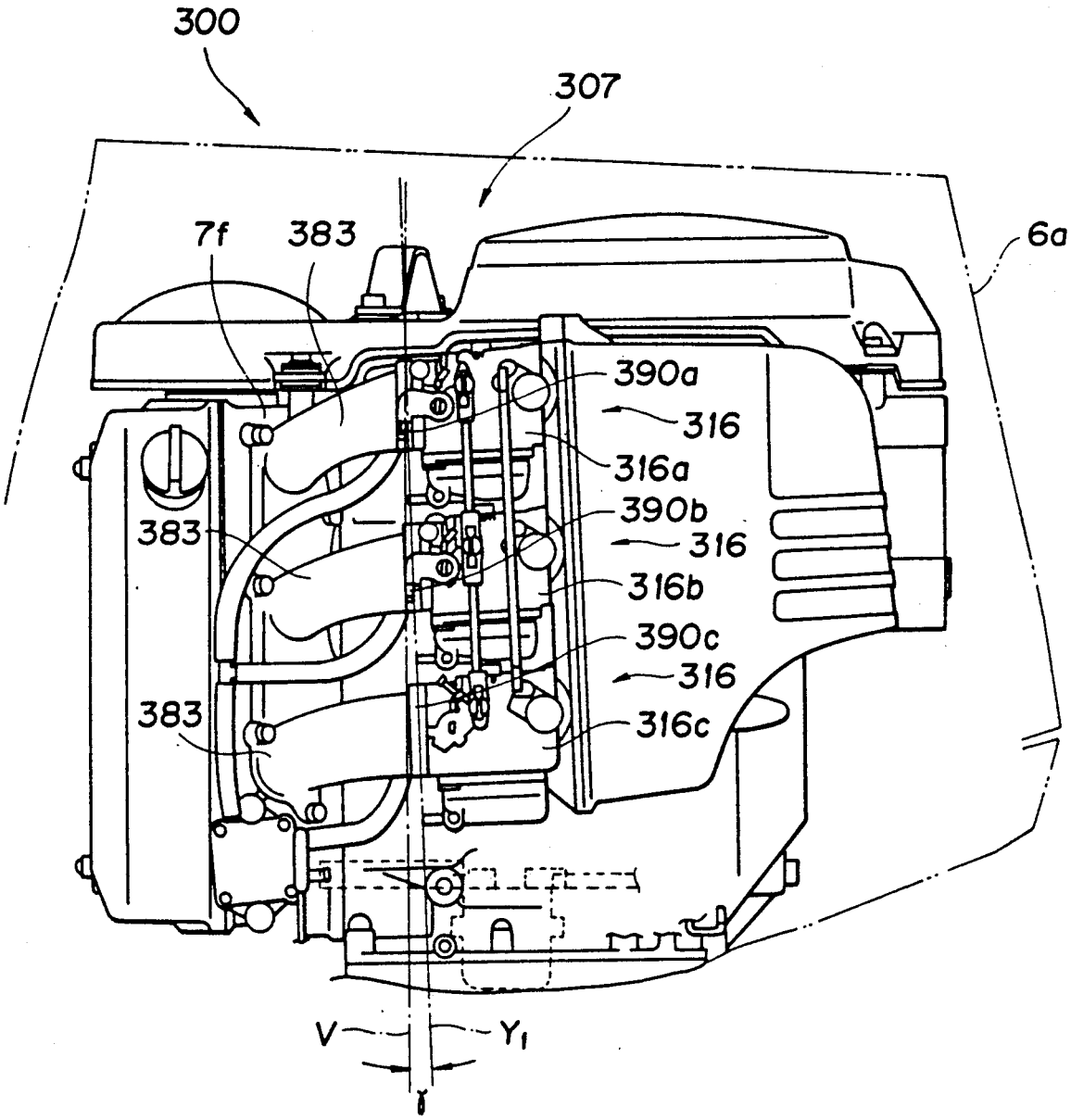
FIG. 8 is a side elevational view of an outboard engine according to a third embodiment of the present invention.

FIG. 8 shows an outboard engine unit 300 which includes an outboard engine 307 according to a third embodiment of the present invention. The outboard engine unit 300 is the same as the outboard engine unit 100 except as follows:

The engine 307 has three intake/fuel supply devices 316 whose carburetors 316*a* through 316*c* are connected to corresponding engine cylinders through three pipes of an intake manifold 383. The pipes of the intake manifold 383 are connected to the carburetors 316*a* through 316*c* at their respective joint surfaces 390*a* through 390*c*. The joint surfaces 390*a* through 390*c* are spaced progressively more apart forwardly from the cylinder head 7*f* of the engine 307 in a downward direction. The line Yl which passes vertically through the joint surfaces 390*a* through 390*c* is inclined forwardly at an angle $\gamma$ with respect to the vertical line V.

The engine 307 of the outboard engine unit 300 is also as advantageous as the engine 7 of the outboard engine unit 100.

The lengths of the pipes of the intake manifold 383 are of the same length. Therefore, the intake manifold 383 can supply an air-fuel mixture at a proper air-fuel ratio to the engine cylinders. As a result, the engine response is stable even while the engine 307 is idling.

With the engine 307, the carburetors 316*a* through 316*c* are not spaced progressively more apart laterally from the axis P of the crankshaft in the downward direction. However, if the carburetors 316*a* through 316*c* are spaced progressively more apart laterally from the crankshaft axis, then the angle $\gamma$ may be reduced.

Figure 9:
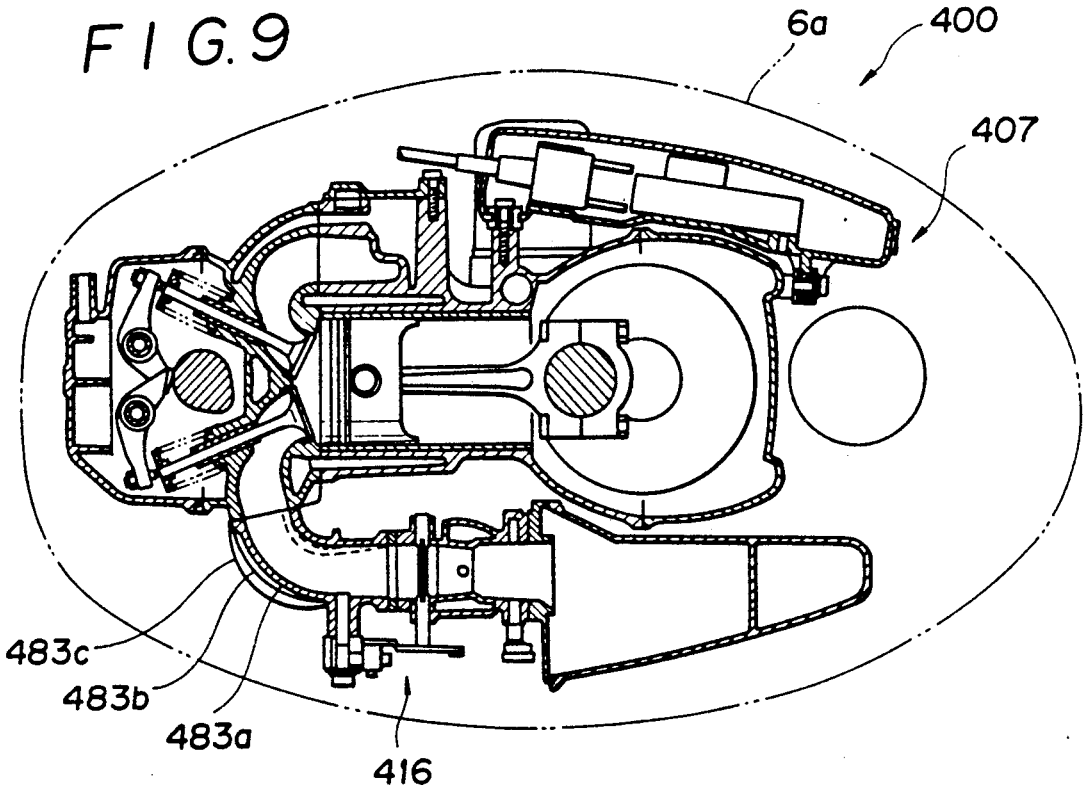
FIG. 9 is a horizontal cross-sectional view of an outboard engine according to a fourth embodiment of the present invention.

FIG. 9 shows an outboard engine unit 400 which includes an outboard engine 407 according to a fourth embodiment of the present invention. The outboard engine unit 400 differs from the outboard engine unit 400 as follows:

Three intake/fuel supply devices 416 are coupled to the engine cylinders through intake manifold pipes 483*a* through 483*c* which have the same length but are curved with different curvatures. More specifically, the intake manifold pipes 483*a*, 483*b*, 483*c* have curved portions extending laterally of the engine block and projecting outwardly and rearwardly more apart from the engine block in the downward direction, i.e., in the order named. Thus, the middle intake manifold pipe 483*b* projects laterally and rearwardly to a greater extent than the upper intake manifold pipe 483*a*, and the lowermost intake manifold pipe 483*c* projects laterally and rearwardly to a greater extent than the middle intake manifold pipe 483*b*.

The engine 407 of the outboard engine unit 400 is also as advantageous as the engine 7 of the outboard engine unit 100.

Since the lengths of the intake manifold pipes 483*a* through 483*c* are of the same length, they can supply an air-fuel mixture at a proper air-fuel ratio to the engine cylinders. As a result, the engine response is stable even while the engine 407 is idling.

In the engine 407, carburetors 416*a* through 416*c* may be spaced progressively more apart laterally from the axis P of the crankshaft in the downward direction, and/or the joint surfaces of the carburetors 416*a* through 416*c* to which the intake manifold pipes 483*a* through 483*c* are joined may be displaced progressively more apart forwardly from the vertical line in the downward direction.

Although there have been described what are at present considered to be the preferred embodiments of the present invention, it will be understood that the invention may be embodied in other specific forms without departing from the essential characteristics thereof. The present embodiments are therefore to be considered in all aspects as illustrative, and not restrictive. The scope of the invention is indicated by the appended claims rather than by the foregoing description.

We claim:

1. An in-line multicylinder outboard engine for an outboard engine unit, comprising:

an engine block having a vertical array of cylinders therein;

a crankshaft disposed substantially vertically in said engine block and having an upper end projecting from an upper surface of said engine block;

a flywheel mounted on said upper end of said crankshaft;

a cylinder head connected to said cylinders;

a camshaft driver unit positioned between a plane in which said flywheel is rotatable and said upper surface of said engine block;

an intake manifold extending from said cylinder head onto one side of said engine block and having pipes of equal length;

a vertical array of intake/fuel supply devices connected respectively to said pipes of said intake manifold; and said intake/fuel supply devices including an uppermost intake/fuel supply device which has at least a portion thereof positioned below said plane in which said flywheel is rotatable and within a region defined laterally of said camshaft driver unit and including respective carburetors, said carburetors being spaced progressively more apart laterally from an axis of said crankshaft in a downward direction.

2. An in-line multicylinder outboard engine for an outboard engine unit, comprising:

an engine block having a vertical array of cylinders therein;

a crankshaft disposed substantially vertically in said engine block and having an upper end projecting from an upper surface of said engine block;

a flywheel mounted on said upper end of said crankshaft;

a cylinder head connected to said cylinders;

a camshaft driver unit positioned between a plane in which said flywheel is rotatable and said upper surface of said engine block;

an intake manifold extending from said cylinder head onto one side of said engine block and having pipes of equal length;

a vertical array of intake/fuel supply devices connected respectively to said pipes of said intake manifold; and said intake/fuel supply devices including an uppermost intake/fuel supply device which has at least a portion thereof positioned below said plane in which said flywheel is rotatable and within a region defined laterally of said camshaft driver unit and including respective carburetors wherein said pipes of said intake manifold being joined to said carburetors through respective joint surfaces, said joint surfaces being spaced progressively more apart laterally from said cylinder head in a downward direction.

3. An in-line multicylinder outboard engine for an outboard engine unit, comprising:

an engine block having a vertical array of cylinders therein;

a crankshaft disposed substantially vertically in said engine block and having an upper end projecting from an upper surface of said engine block;

a flywheel mounted on said upper end of said crankshaft;

a cylinder head connected to said cylinders;

a camshaft driver unit positioned between a plane in which said flywheel is rotatable and said upper surface of said engine block;

an intake manifold extending from said cylinder head onto one side of said engine block and having pipes of equal length having curved portions extending laterally of said engine block, said curved portions projecting progressively more apart outwardly from said engine block in a downward direction;

a vertical array of intake/fuel supply devices connected respectively to said pipes of said intake manifold; and said intake/fuel supply devices including an uppermost intake/fuel supply device which has at least a portion thereof positioned below said plane in which said flywheel is rotatable and within a region defined laterally of said camshaft driver unit.

4. An in-line multicylinder outboard engine for an outboard engine, comprising:

a vertical array of cylinders having respective axes directed horizontally, said cylinders being spaced at a first vertical pitch;

each of said cylinders having an intake port and an exhaust port;

pistons slidably fitted respectively in said cylinders;

a crankshaft operatively coupled to said pistons through connecting rods and having a vertical axis;

a vertical array of as many carburetors as the number of cylinders, said carburetors being associated respectively with said cylinders and spaced at a second vertical pitch which is larger than said first vertical pitch such that said carburetors are positioned higher than said intake ports, respectively, of the corresponding cylinders with which said carburetors are associated; and an intake manifold having pipes connecting said carburetors to said intake ports of the corresponding cylinders, said pipes having equal lengths.

5. An in-line multicylinder outboard engine according to claim 4, further comprising an engine block including a crankcase in which said crankshaft is disposed, said crankshaft having an upper end projecting from an upper surface of said engine block, and a flywheel mounted on said upper end of the crankshaft, said carburetors being positioned below a plane in which said flywheel is rotatable.

6. An in-line multicylinder outboard engine for an outboard engine unit, comprising:

an engine block including a cylinder block having a vertical array of said multiple cylinders;

a crankshaft disposed substantially vertically in said engine block and having an upper end projecting from an upper surface of said engine block;

a flywheel mounted on said upper end of said crankshaft;

a cylinder head connected to said cylinders;

a belt transmission mechanism positioned between a plane in which said flywheel is rotatable and said upper surface of said engine block;

an intake manifold extending from said cylinder head onto one side of said engine block and having pipes;

a vertical array of carburetors connected respectively to said pipes of said intake manifold;

said pipes of said intake manifold extending obliquely downwardly from said carburetors to said cylinder head; and said carburetors including an uppermost carburetor which has at least a portion thereof positioned below said plane in which said flywheel is rotatable and within a region defined laterally of said belt transmission mechanism above an upper end of said cylinder block;

7. An in-line multicylinder outboard engine according to claim 6, further including links connected to said carburetors and disposed on one side thereof.

8. An in-line multicylinder outboard engine according to claim 6 or 7, wherein said uppermost carburetor is spaced a greater distance from a plane, which includes an axis of said crankshaft and axes of said cylinders than the other carburetors, than said uppermost carburetor.

9. An in-line multicylinder outboard engine according to claim 8, wherein said pipes of said intake manifold extending from said cylinder head have equal lengths.

10. An in-line multicylinder outboard engine according to claim 9, wherein said carburetors are spaced progressively more apart laterally from a plane which includes an axis of said crankshaft and axes of said cylinders in a downward direction.

11. An in-line multicylinder outboard engine according to claim 9, wherein said pipes of said intake manifold are joined to said carburetors through respective joint surfaces, said joint surfaces being spaced progressively more apart laterally from said cylinder head toward a crankcase, in which said crankcase is disposed in a downward direction.

12. An in-line multicylinder outboard engine according to claim 6 or 7, wherein said pipes of said intake manifold extending from said cylinder head have equal lengths.

13. An in-line multicylinder outboard engine according to claim 12, wherein said carburetors are spaced progressively more apart laterally from a plane which includes an axis of said crankshaft and axes of said cylinders in a downward direction.

14. An in-line multicylinder outboard engine according to claim 12, wherein said pipes of said intake manifold are joined to said carburetors through respective joint surfaces, said joint surfaces being spaced progressively more apart laterally from said cylinder head toward a crankcase in which said crankshaft is disposed in a downward direction.

15. An in-line multicylinder outboard engine housed in a casing means for an outboard engine unit, comprising:

an engine block having a vertical array of said multiple cylinders therein;

a crankshaft disposed substantially vertically in said engine block and having an upper end projecting from an upper surface of said engine block;

a flywheel mounted on said upper end of said crankshaft;

a cylinder head connected to said cylinders;

a belt transmission mechanism positioned between a plane in which said flywheel is rotatable and said upper surface of said engine block;

an intake manifold extending from said cylinder head onto one side of said engine block and having pipes;

a vertical array of carburetors connected respectively to said pipes of said intake manifold;

said pipes of said intake manifold extending obliquely downwardly from said carburetors to said cylinder head;

said pipes of said intake manifold being inclined at progressively smaller angles in a downward direction; and said carburetors including an uppermost carburetor which has at least a portion thereof positioned below said plane in which said flywheel is rotatable and within a region defined laterally of said belt transmission mechanism above an upper end of said cylinder block.

16. An in-line multicylinder outboard engine according to claim 15, wherein said casing means includes an engine cover and a lower case; and said engine is housed in said engine cover and said lower case.

17. An in-line multicylinder outboard engine housed in a casing means for an outboard engine unit, comprising:

a vertical array of said multiple cylinders having respective axes directed horizontally, said cylinders being spaced at a first vertical pitch;

each of said cylinders having an intake port and an exhaust port;

pistons slidably fitted respectively in said cylinders;

a crankshaft operatively coupled to said pistons through connecting rods and having a vertical axis;

a vertical array of as many carburetors as the number of said cylinders;

an intake manifold having pipes connecting said carburetors to said intake ports of corresponding cylinders;

said pipes of said intake manifold extending obliquely downward from said carburetors to said cylinder head;

said pipes of said intake manifold being inclined at progressively smaller angles in a downward direction; and said pipes of said intake manifold being spaced at a second vertical pitch which is larger than said first vertical pitch.

* * * * *